United States Patent [19]

Westfall

[11] Patent Number: 4,941,285

[45] Date of Patent: Jul. 17, 1990

[54] LIFT-OFF SHOE SYSTEM FOR TILT WINDOW

[75] Inventor: Norman R. Westfall, Rochester, N.Y.

[73] Assignee: Caldwell Manufacturing Company, Rochester, N.Y.

[21] Appl. No.: 422,669

[22] Filed: Oct. 17, 1989

[51] Int. Cl.[5] ..... E05D 15/22

[52] U.S. Cl. ..... 49/176; 49/446; 49/453; 49/506

[58] Field of Search ..... 49/176, 161, 181, 446, 49/445, 453, 454, 506

[56] References Cited

U.S. PATENT DOCUMENTS

| | | | |
|---|---|---|---|
| 3,399,490 | 9/1968 | Hettinger | 49/414 |
| 3,434,237 | 3/1969 | Love | 49/181 |
| 3,482,354 | 12/1969 | Trout | 49/181 |
| 3,611,636 | 10/1971 | Trout | 49/181 |
| 3,789,549 | 2/1974 | Yip | 49/181 |
| 3,797,168 | 3/1974 | Trout | 49/453 X |
| 4,068,406 | 1/1978 | Wood | 49/446 X |
| 4,446,654 | 5/1984 | Schoolman et al. | 49/181 |
| 4,452,012 | 6/1984 | Deal | 49/181 |
| 4,570,382 | 2/1986 | Suess | 49/445 X |
| 4,799,333 | 1/1989 | Westfall et al. | 49/446 |

*Primary Examiner*—Philip C. Kannan

*Attorney, Agent, or Firm*—Stonebraker, Shepard & Stephens

[57] ABSTRACT

A lift-off shoe system uses non-locking sash support shoes (30) movable vertically and spring biased upwardly in a tilt window. Sash pins (25) have heads (26) that interlock with open top slots (31) in sash shoes (30) so that the sash pins are removable from the shoes only by lifting the pins vertically from above the uppermost position of the shoes. This simplifies the shoes, eliminates damage caused by shoe-locking mechanisms, and makes sash removal and replacement simple and convenient.

30 Claims, 2 Drawing Sheets

LIFT-OFF SHOE SYSTEM FOR TILT WINDOW

BACKGROUND

Support shoes for tilt windows have caused many problems. Understanding what these problems are and what causes them underlies the reasons for a shoe system that I have devised to solve the problems. The way the problems are seen, though, necessarily affects the way the solutions are devised, so that my view of the problems becomes part of my invention—by setting the goals to be met.

With that understood, I have recognized that previous tilt window shoe systems suffer the following problems:

Most shoe systems require lateral withdrawal of the sash pins from the shoes, and lateral replacement of the sash pins into recesses in the shoes. Replacing the pins into the recesses is difficult, because it is hard to hold the sash in position and also see to guide the pins into the shoe recesses.

For relatively inexpensive shoe systems that do not lock when the sash is tilted and removed, sash pin withdrawal from the shoes sometimes damages the window hardware. This occurs because the sash must be slanted to withdraw its pins laterally from the shoes, and this necessarily pulls one shoe down below the other to where it can snap upward under spring tension when the lower pin is withdrawn. As the upward snap occurs, an extension counterbalance spring can contract coil-to-coil and transmit the snapping force to the top of the spring, where it can damage or dislodge the spring anchor. The snapping force can also damage the shoe.

The shoes that lock against upward movement must allow one shoe to move downward relative to the other so that the sash can be slanted for withdrawal. Lowering one side of the sash is less natural than lifting one side of the sash to achieve the slant necessary for withdrawal.

Shoes that lock sometimes fail from the abuse they suffer. People try to force them upward from a locked position, as appears to be necessary for slanting the sash; and this can break the locking mechanisms or damage the jamb liner.

Shoe systems must survive construction site environments, where the jamb liners are filled with dry wall dust, and the windows are treated more roughly than in home owner usage. Dry wall dust is abrasive and generally increases the friction of moving the shoes vertically within the jamb liners. The shoes must have enough friction to prevent hop and drop, but not so much that they stick fast when subjected to dry wall dust.

Shoes locked with their springs extended place considerable stress on the resin jamb liners. In warm weather, this stress, which can be applied for days at a time at construction sites, can deform jamb liners.

Shoe systems, although essential to tilt windows, are under competitive price pressure so that they must be made at a low cost to avoid customer price resistance. Thus, any solution to the many shoe problems must be one that can be made at a low and competitive cost.

When a sash is tilted inward from the plane of the jamb liner, the counterbalance springs pulling upward on the support shoes are relieved of the weight of the upper part of the sash, and they tend to yank the bottom of the window upward. Some shoe systems prevent this by locking the shoes when the sash is tilted, but those that do not lock give the feeling of the sash being jerked upward out of control.

Shoe systems have not been designed to take advantage of the exploratory movements that a sash remover is likely to try, in getting the sash out of the window. This happens infrequently enough so that the home owner often has forgotten the operative motions and feels his way toward movements that do work. An optimum shoe system would put no restraints on this and would not let any attempted movement cause damage. It would also make the most likely movements be the ones to succeed in removing the sash.

This list is not exhaustive of the problems of support shoes in tilt windows, but it includes the many problems that my support shoe system solves. In doing so, my shoe system aims at trouble-free functioning in all the circumstances that a tilt window system may encounter, while reducing the manufacturing costs so that the functional advantages can be competitively priced.

SUMMARY OF THE INVENTION

My sash shoe system for a tilt window uses headed sash pins that interlock in open top slots in sash shoes that do not lock in place when the sash is tilted or removed. The sash pins cannot be withdrawn laterally from the shoes and can only be lifted above the shoes when the shoes are raised to their uppermost positions, for withdrawing the sash from the window.

The shoes of my system are also connected to counterbalance spring systems in regions that are offset from the pin slot so that the shoes are canted by the moment arm between the upward bias of the spring and the downward weight of the sash. This makes upper and lower corners of the shoe rub against the jamb liner channel to produce a friction that is automatically related to sash weight.

Shoes for my system preferably have friction screws that can be turned in and out of the shoes to rub against the jamb liner for producing an adjustable friction. I also prefer that each shoe have a block of elastomeric material that rubs against the jamb liner as the shoe moves vertically, to add friction that slows down shoe movement, especially when an upper end of a sash is tilted out of the plane of the jamb liners; and the reduced weight on the lower end of the sash is lifted upward by the counterbalance springs.

DRAWINGS

DETAILED DESCRIPTION

Figure 1:
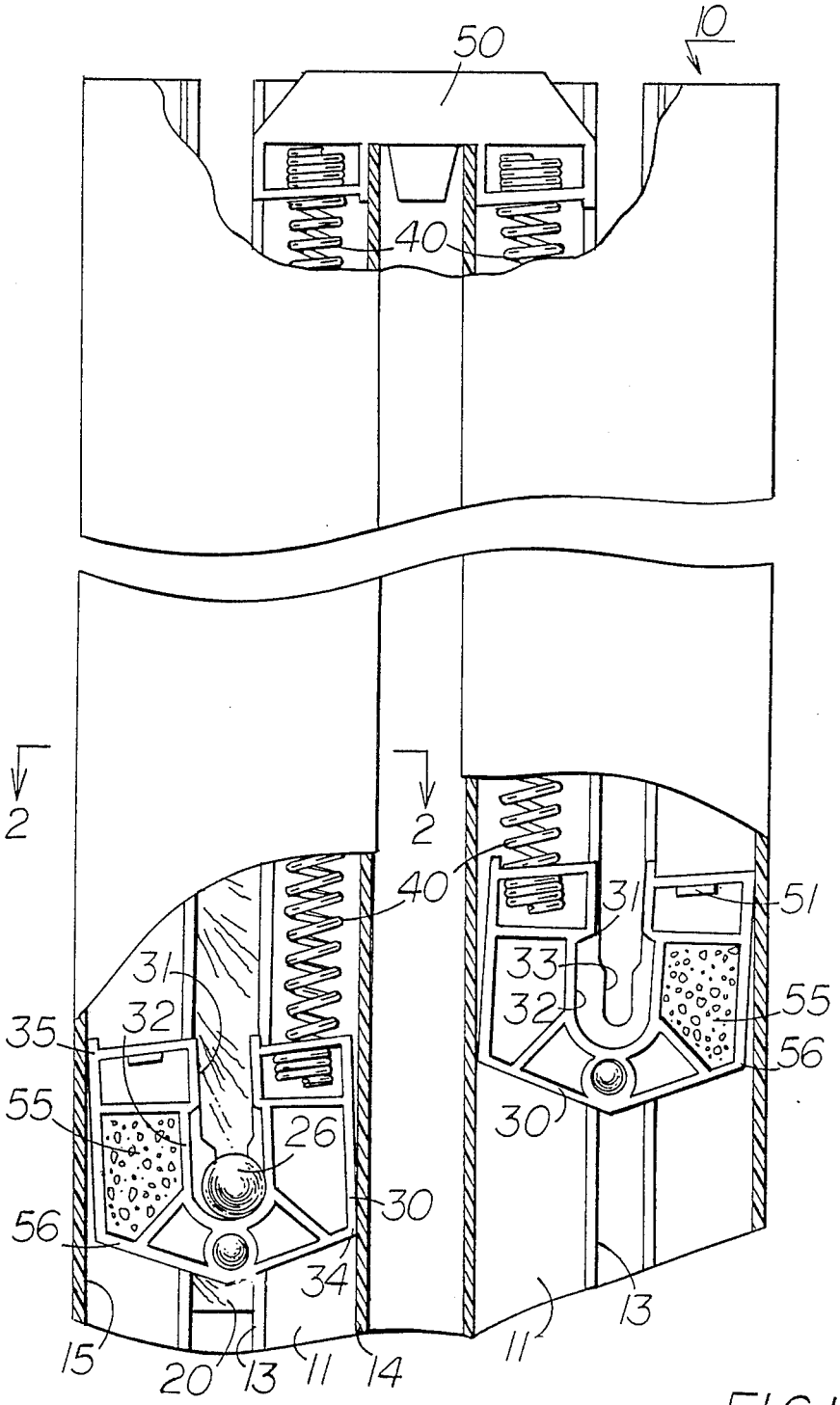
FIG. 1 is a partially cutaway side elevational view of the frame side of a jamb liner holding a preferred embodiment of my lift-off shoe system for a tilt window and showing a sash in one sash run and a sash removed from another sash run.

My lift-off shoe system applies to a tilt window using a sash 20 that can move vertically between a pair of jamb liners 10. These are preferably extruded of resin material, and a preferred embodiment of one jamb liner 10 is partially illustrated in FIGS. 1 and 2.

Each jamb liner 10 is formed to provide a pair of shoe channels 11, and each channel 11 contains a shoe 30 that can move vertically within jamb liner 10. A vertical slot 13 on the sash side of each channel 11 opens into channel 11 so that a pin 25 can extend from sash 20 through slot 13 and into channel 11 where the pin 25 engages shoe 30.

Figure 2:
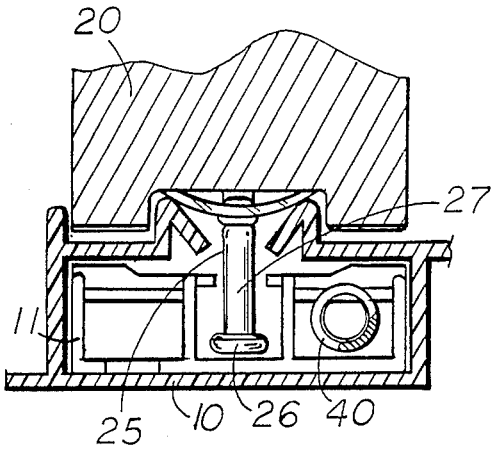
FIG. 2 is a cross-sectional view of the embodiment of FIG. 1, taken along the line 2—2 thereof.
Figure 3:
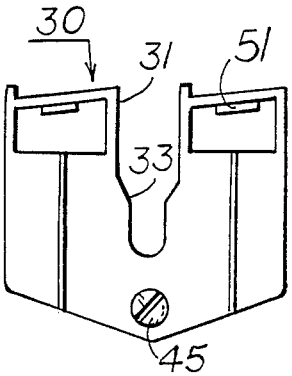
FIG. 3 is an elevational view of the window side of a sash shoe such as shown in FIGS. 1 and 2.
Figure 4:
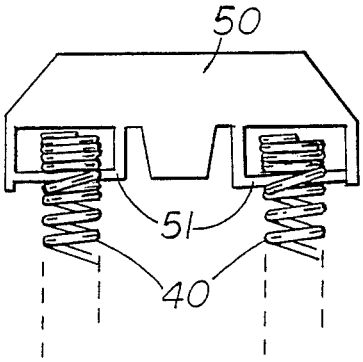
FIG. 4 is an elevational view of the window side of the spring anchor shown in FIG. 1.

Each shoe 30 is counterbalanced by a spring system such as the illustrated extension spring 40 that extends upward within channel 11 to an upper region of jamb liner 10. There, a top bracket 50 attaches to each counterbalance spring 40, to anchor the springs in place. This biases both shoes 30 upward within channels 11 to counterbalance the weight of sash 20, which is supported on shoes 30 by pins 25. In the illustration of FIG. 1, one sash 20 has been removed from the sash run on the right side of jamb liner 10, and another sash 20 remains in place in the left sash run of jamb liner 10.

Shoes 30 for my lift-off shoe system do not lock in place in channels 11. Instead, they accomplish the supporting and counterbalancing of sash 20 and accommodate its tilting and removal from jamb liner 10 without any locking in a vertical position within channels 11. This simplifies shoes 30 and allows them each to be made of a single piece of resin material. It also eliminates many of the problems caused by locking of sash shoes within the jamb liners of tilt windows.

Instead of locking in place, to allow lateral withdrawal of sash pins 25, my shoes 30 have open top slots 31 that allow sash pins 25 to be lifted vertically above shoes 30, while shoes 30 are at their uppermost positions. Sash pins 25 have heads 26 that interlock with slots 31 in shoes 30 so that pins 25 cannot be laterally withdrawn from shoes 30. This ensures that pins 25 stay engaged with and supported by shoes 30 at all times except when pins 25 are lifted above the uppermost position of shoes 30 to remove sash 20 from the window.

To accommodate the interlock between pin heads 26 and open top slots 31, I prefer that slots 31 have a wide region 32, separated from sash 20 by a narrow region 33. I also prefer that the open top of slot 31 be flared outward to allow sash pins 25 to slide easily into slots 31 from above. Narrow region 33 is wide enough to receive the stem 27 of sash pin 25, but narrow enough to block passage of the head 26 of pin 25. Pin head 26 then rests in the wider internal region 32 of slot 31 where it cannot be withdrawn laterally from shoe 30.

For coiled extension springs 40 I prefer that the spring connectors for shoes 30 and top bracket 50 be wedge retainers 51 that can slide between coils of a spring and interlock with the spring to retain it in place. Wedge connectors 51 are preferably angled from the horizontal, as illustrated, to match the pitch of spring 40, and keep spring 40 vertical where wedge retainer 51 fits between spring coils. Use of wedge retainers 51 saves bending the terminal coils of springs 40, which weakens them, and is otherwise a simple and effective way of anchoring each end of springs 40.

To accommodate a pair of counterbalance springs 40, if necessary for counterbalancing a specially heavy sash 21, I also prefer a pair of wedge retainers 51 on each shoe 30. This would require a different top bracket 50 arranged to connect to a pair of springs 40 extending upward within a single channel 11. Two wedge retainers 51 also allow shoes 30 to be made identical for accommodating a counterbalance spring 40 on either side, so that each shoe can serve in either jamb liner channel. Of course, different counterbalance connectors can be used for other types of counterbalance spring systems.

For most of the sashes 20 to be counterbalanced with my lift-off shoe system, a single counterbalance spring system is adequate. For the illustrated extension spring 40, I prefer that this be connected to a wedge retainer 51 in a position offset from a vertical line through the center of shoe slot 31. This keeps the counterbalance spring neatly arranged on one side of channel 11, where it is clear of channel slot 13. The counterbalance springs then do not interfere with replacement of pins 25 back into shoe slots 31, as is necessary for replacing sash 20 into the window.

The preferred offset connection of springs 40 relative to pin support slots 31 also has a desirable frictional effect. The upward counterbalance force exerted by the spring system is offset from pin 25 and slot 31, which bear the weight of sash 20. This offset tilts shoes 30 so that a lower corner 34 and an upper corner 35 are pressed against respective side walls 14 and 15 of channel 11, as shown in FIG. 1. The frictional engagement of shoe corners 34 and 35 with channel walls 14 and 15 is automatically related to the sash weight and the counterbalance force of the spring system to provide a frictional resistance against hop and drop of sash 20. The sash can then stay in place in an uppermost position, where the force of counterbalance spring 40 is light, and can also stay in place in a lowermost position, where the counterbalance force of spring 40 is heavier.

The frictional effect of shoe corners 34 and 35 pressing against channel walls 14 and 15 also depends on the lateral offset between spring 40 and pin 25 and the vertical distance between lower corner 34 and upper corner 35. I prefer that the lateral offset of spring 40 be from 0.2 to 0.5 times the vertical distance between upper corner 35 and lower corner 34 of shoe 30. Larger offsets and shorter vertical shoe heights increase the frictional force from canting shoe 30.

The frictional resistance of shoes 30 to vertical movement in channels 11 is also preferably adjustable by means of a screw 45 that is threaded through the body of shoe 30 to engage a back wall of channel 11. The deeper screw 45 is threaded into shoe 30, the harder it presses against the back wall of channel 11, and the more it increases the frictional movement resistance of shoe 30.

Another feature that I prefer for my lift-off shoe system is a block or piece of elastomeric material 55 carried on each shoe 30 to reduce the speed of shoe movement when sash 20 is tilted out of the plane of the window. As this occurs, the sash weight on pins 25 supported by shoes 30 is greatly reduced so that counterbalance springs 40 tend to snap shoes 30 rapidly upward. This can give a sash remover a feeling of loss of control as the bottom end of the tilted sash rises rapidly in the window. Elastomeric material 55 overcomes this by producing increased frictional resistance against rapid movement. Material 55 can be a foamed resin elastomer, for example, and can be lodged in place in a recess 56 in the back side of shoe 30. For slow movement of a shoe 30 in channel 11, as a sash is raised and lowered, elastomeric material 55 is only slightly deformed and offers low frictional resistance. More rapid movement of shoe 30 in channel 11 deforms elastomeric material 55 by a greater amount and increases its frictional resistance. This tends to dampen or slow down the movement of shoe 30 so that while it rises in response to tilting of sash 20, it does so at a moderate rate of speed that is not alarming to the person who tilted the sash.

To remove a sash 20 supported by my lift-off shoe system, sash 20 is first tilted inward, as is normally done for tilt windows. This does not lock shoes 30, however, which are free to rise in response to the reduced supported weight of sash 20. Shoes 30 then rise at a moderate speed to their uppermost positions, where counterbalance springs 40 are fully retracted. This occurs at or slightly above the middle of a typical double-hung window. This movement also occurs automatically as the sash remover holds the upper end of the tilted sash.

Once the lower end of the tilted sash has reached its uppermost position, where counterbalance springs 40 will lift it no higher, then removal of the sash from the window can occur. This is done by slanting the sash to lift one of the pins 25 vertically upward out of a shoe slot 31. This can be done without any interference from spring 40; and it is a likely movement for the sash remover to attempt, in slanting the window for withdrawal.

Once one of the sash pins 25 lifts upward to clear a shoe 30 and withdraw from liner slot 13, it follows naturally for the sash remover to lift the other pin clear of its shoe and out of liner slot 13 so that the sash is withdrawn from the window.

Replacing a withdrawn sash is also simple. Instead of laterally replacing sash pins into shoes that are locked somewhere within the jamb liners and are difficult to see, the sash replacer merely slants the sash so that the pins 25 can enter the liner slots 13 above the uppermost positions of shoes 30. Then the sash is lowered so that pins 25 move downwardly into shoe slots 31. The outward flare at the upper end of slots 31 aids in this process, and the offset mounting of spring 40 keeps it clear of downwardly descending sash pins 25. Once these are lowered into engagement with slots 31, shoes 30 partially support the weight of the sash. The sash replacer can feel this occur and realize that the sash pins are properly engaged with the sash shoes. All that remains is then to tilt the sash back into the plane of the window. As this is done, shoes 30 support and counterbalance the full weight of sash 20.

A lack of any locking mechanism not only simplifies shoes 30, but prevents damage to liner 10 or shoes 30 if a locking mechanism is forced and broken. Unlocked shoes that return automatically to their uppermost positions also simplify withdrawal and replacement of the sash, so long as sash pins 25 have heads 26 that interlock with slots 31 and are removable only vertically from slots 31. Shoes 30 also provide the friction necessary to prevent hop and drop of the sash and do this automatically in cooperation with the offset of springs 40 from pins 25. The amount of this friction can be designed as desired by varying the spring offset from the sash pin and the vertical distance between upper and lower corners of the shoe. The rise of the shoes when the sash is tilted is dampened or slowed by the preferred use of an elastomeric material 55, and overall friction of shoe 30 is additionally adjustable by means of screw 45.

I claim:

1. A shoe system for a tilt window having a sash that moves vertically between a pair of jamb liners, tilts from the plane of said jamb liners, and has a pair of sash pins that extend into a pair of spring counterbalanced, nonlocking shoes that move vertically within said jamb liners, said shoe system comprising:

a. said shoes having top opening slots that receive said sash pins;

b. said pins having heads that interlock with said slots and prevent lateral withdrawal of said pins from said shoes; and c. said pins being removable from said shoes only by lifting said pins upward out of said top opening slots into a region above uppermost positions of said shoes.

2. The system of claim 1 wherein counterbalance elements are connected to said shoes in positions offset from said sash pins by an amount large enough relative to the vertical height of said shoes to cant said shoes against said jamb liners to produce friction adequate to overcome hop and drop of said sash.

3. The system of claim 1 wherein said shoes have spring connectors formed as wedge retainers insertable between end region coils of counterbalance extension springs.

4. The system of claim 1 wherein each of said shoes has a pair of counterbalance connectors arranged on opposite sides of said slots.

5. The system of claim 1 wherein each of said shoes has a threaded friction screw for adjusting the friction of said shoes within said jamb liners.

6. The system of claim 1 wherein said top opening slots have narrow regions confronting said sash and wider regions spaced from said sash so that said heads of said pins can turn within said wider regions and interlock with said narrow regions through which stems of said pins extend.

7. The system of claim 1 including an elastomeric material lodged in each of said shoes to rub against said jamb liner as said shoes move in said jamb liner, for slowing upward movement of said shoes when said sash is tilted.

8. The system of claim 1 including a spring anchor lodged in an upper region of each of said jamb liners to cover a parting bead region of said jamb liners and extend to both sash run regions of said jamb liners.

9. The system of claim 8 wherein said spring anchor has a pair of wedge retainers that are insertable between upper coils of a pair of counterbalance extension springs.

10. In a tilt window having a tilt sash moving vertically between a pair of jamb liners holding vertically movable, non-locking sash shoes that engage pins extending from said sash into said jamb liners, the improvement comprising:

a. said pins having heads and said shoes having open top slots receiving said pins so that said heads prevent lateral withdrawal of said pins from said shoes;

b. a counterbalance spring system arranged for biasing each of said shoes upward with said pins to an uppermost position of said shoes where said pins can be removed from said shoes by being lifted upward from said slots to a region above said uppermost positions of said shoes; and c. said counterbalance spring systems having elements connected to said shoes in positions offset from said pins by a distance that is large enough relative to the vertical height of said shoes to cant said shoes within said jamb liners so that corners of said shoes engage said jamb liners with sufficient friction to overcome hop and drop of said sash.

11. The improvement of claim 10 wherein said shoes have wedge retainers that are insertable between and region coils of extension springs, for connecting said extension springs to said shoes.

12. The improvement of claim 10 wherein each of said shoes has a pair of counterbalance connectors arranged on opposite sides of said slot.

13. The improvement of claim 10 wherein said open tops of said slots are flared for receiving said pins when a sash is replaced to a position between said jamb liners.

14. The improvement of claim 10 wherein adjustable friction devices are mounted on said shoes.

15. The improvement of claim 14 wherein said friction devices comprise screws threaded through said shoes to engage said jamb liners.

16. The improvement of claim 14 wherein said friction devices comprise elastomeric material lodged in said shoes to bear against said jamb liners as said shoes move.

17. The improvement of claim 10 wherein said slots have wider regions for receiving said heads of said pins and narrower regions disposed between said sash and said wider regions so that stems of said pins can extend through said narrower regions to said sash.

18. The improvement of claim 10 wherein each of said jamb liners has a pair of sash runs and a spring anchor lodged to extend over a parting bead region and into each of said sash runs.

19. The improvement of claim 18 wherein each end region of said spring anchor has a wedge retainer insertable between upper coils of a counterbalance extension spring.

20. A method of removing and replacing a sash of a tilt window, said method comprising:

a. tilting said sash out of the plane of jamb liners for said window, without locking spring-balanced sash shoes supporting said sash within said jamb liner;
b. holding an upper region of the tilted out sash while allowing said sash shoes to rise to their uppermost shoe positions within said jamb liners;
c. lifting headed sash pins out of open top slots in said shoes to lift said sash pins clear of said shoes above said uppermost positions of said shoes;
d. slanting said sash with said pins above said shoes to remove said pins from said jamb liners and then removing said sash from said window;
e. reinserting said sash pins into said jamb liners above said uppermost positions of said shoes;
f. lowering said pins into said open top slots of said shoes so that heads of said pins engage said shoes;
g. lowering said shoes with said sash pins and said sash below said uppermost positions of said shoes; and
h. tilting said sash back into said plane of said jamb liners.

21. The method of claim 20 including slanting said sash for reinserting said sash pins into said jamb liners above said shoes.

22. The method of claim 20 including laterally interlocking said heads of said pins within said slots in said shoes.

23. A lift-off shoe and sash pin combination for a tilt window, said shoe having a body shaped to run in a vertical channel of said jamb liner, and said combination comprising:

a. said body being formed of a single piece of resin material having an open top slot;
b. said slot having a narrow region on a sashconfronting side of said shoe and a wider region spaced from said sash-confronting side of said shoe;
c. a head of said sash pin being sized for lowering down into said wider region, and being unable to pass through said narrow region so that said narrow region prevents lateral withdrawal of said head in any angular orientation of said pin;
d. a stem of said sash pin being sized to extend through said narrow region; and
e. said pin being removable upward from said open top slot for withdrawal from said shoe in any angular orientation of said pin.

24. The combination of claim 23 wherein said body has a counterbalance connector offset from said open top slot.

25. The combination of claim 24 wherein said offset of said counterbalance connector from said slot is from 0.2 to 0.5 times the vertical distance between upper and lower corners of said shoe.

26. The combination of claim 24 wherein one of said counterbalance connectors is arranged on each side of said open top slot.

27. The combination of claim 23 wherein said body has a spring connector formed as a wedge retainer insertable between end regions coils of an extension spring.

28. The combination of claim 23 wherein said open top of said slot is flared to receive said sash pin.

29. The combination of claim 23 wherein an adjustable friction screw extends through said body to bear against said jamb liner.

30. The combination of claim 23 wherein a block of elastomeric material is lodged in said body to bear against said jamb liner.

* * * * *